US010474174B2

(12) United States Patent
Na et al.

(10) Patent No.: US 10,474,174 B2
(45) Date of Patent: Nov. 12, 2019

(54) PROGRAMMABLE SUPPLY GENERATOR

(71) Applicant: INTEL CORPORATION, Santa Clara, CA (US)

(72) Inventors: Taesik Na, Atlanta, GA (US); Harish K. Krishnamurthy, Beaverton, OR (US); Xiaosen Liu, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/479,217

(22) Filed: Apr. 4, 2017

(65) Prior Publication Data

US 2018/0284823 A1 Oct. 4, 2018

(51) Int. Cl.
*H02M 3/335* (2006.01)
*G05F 1/575* (2006.01)

(52) U.S. Cl.
CPC ..... *G05F 1/575* (2013.01)

(58) Field of Classification Search
CPC ..... G05F 3/08; G05F 3/242; H03K 19/173; H03K 19/177
USPC ..... 323/280, 282, 285, 288, 311–316; 327/530, 534, 540
See application file for complete search history.

(56) References Cited

U.S. PATENT DOCUMENTS 5,945,853 A * 8/1999 Sano ..... G01R 19/0092 327/87
7,230,408 B1 * 6/2007 Vinn ..... H02M 3/156 323/273
7,262,658 B2 * 8/2007 Ramaswamy ..... H03F 1/30 330/10
7,531,996 B2 * 5/2009 Yang ..... G05F 1/575 323/280
8,022,681 B2 * 9/2011 Gurcan ..... G05F 1/565 323/283
8,304,931 B2 * 11/2012 Gurcan ..... H02M 1/088 307/82
8,547,135 B1 * 10/2013 Yarlagadda ..... G06F 1/26 323/281
8,866,460 B2 * 10/2014 Huang ..... G05F 1/46 323/274
8,922,272 B1 * 12/2014 Kose ..... G05F 1/462 327/541
8,975,916 B1 * 3/2015 Yarlagadda ..... G06F 1/26 326/38
9,362,888 B2 * 6/2016 Chappaz ..... H03H 11/0405
9,417,643 B2 * 8/2016 Saint-Laurent ..... G05F 1/468
9,594,391 B2 * 3/2017 de Cremoux ..... G05F 3/08
(Continued)

OTHER PUBLICATIONS

Hazucha, P. et al., "Area-Efficient Linear Regulator with Ultra-Fast Load Regulation", IEEE Journal of Solid-State Circuits, vol. 40, No. 4, Apr. 2005, pp. 993-940.

(Continued)

*Primary Examiner* — Rajnikant B Patel
(74) *Attorney, Agent, or Firm* — Green, Howard, & Mughal LLP

(57) ABSTRACT

An apparatus is provided which includes: a first set of devices which is digitally controlled by a first feedback loop that includes a first comparator; and a second set of devices which is controlled by an analog circuitry which is part of a second feedback loop that includes an amplifier, wherein the first set of devices is coupled in parallel to the second set of devices.

24 Claims, 12 Drawing Sheets

(56) References Cited

U.S. PATENT DOCUMENTS

| | | | | |
|---|---|---|---|---|
| 9,602,016 | B2 * | 3/2017 | Freeman | H02M 3/33546 |
| 9,778,667 | B2 * | 10/2017 | Peluso | G05F 1/56 |
| 2010/0079114 | A1 * | 4/2010 | So | H01M 10/44 320/137 |
| 2010/0141223 | A1 * | 6/2010 | Wadhwa | G05F 1/56 323/280 |
| 2012/0146595 | A1 | 6/2012 | Wong | |
| 2013/0076323 | A1 | 3/2013 | Huang et al. | |
| 2014/0218011 | A1 | 8/2014 | Naghane et al. | |
| 2014/0277812 | A1 * | 9/2014 | Shih | G05F 1/563 700/298 |
| 2015/0180430 | A1 * | 6/2015 | Wang | H03F 3/217 381/120 |
| 2015/0241890 | A1 * | 8/2015 | Raychowdhury | G05F 1/56 713/300 |
| 2016/0334818 | A1 * | 11/2016 | Singh | G05F 1/56 |

OTHER PUBLICATIONS

Nasir, "All-Digital Low-Dropout Regulator with Adaptive Control and Reduced Dynamic Stability for Digital Load Circuits", IEEE Transactions on Power Electronics, vol. 31, No. 12, Dec. 2016, pp. 8293-8302.

International Search Report and Written Opinion from PCT/US2018/020982 notified Jun. 27, 2018, 14 pgs.

* cited by examiner

500

600

PROGRAMMABLE SUPPLY GENERATOR

BACKGROUND

Presently, integrated circuit (IC) designs incorporate large number of power domains and necessitate many low dropout circuits (LDOs), where the required specifications are various. Some applications, for example in the Internet-of-Things (IoT) space, need very little quiescent current for their LDOs while performance parameter such as Power Supply Rejection Ratio (PSRR) is not very important. On the other hand, applications like RF (Radio Frequency) and high speed input-output (IOs) transceivers may require high PSRR LDO design. Thus several LDO designs are required to meet those targets leading to tremendous design efforts.

BRIEF DESCRIPTION OF THE DRAWINGS

The embodiments of the disclosure will be understood more fully from the detailed description given below and from the accompanying drawings of various embodiments of the disclosure, which, however, should not be taken to limit the disclosure to the specific embodiments, but are for explanation and understanding only.

DETAILED DESCRIPTION

Figure 1:
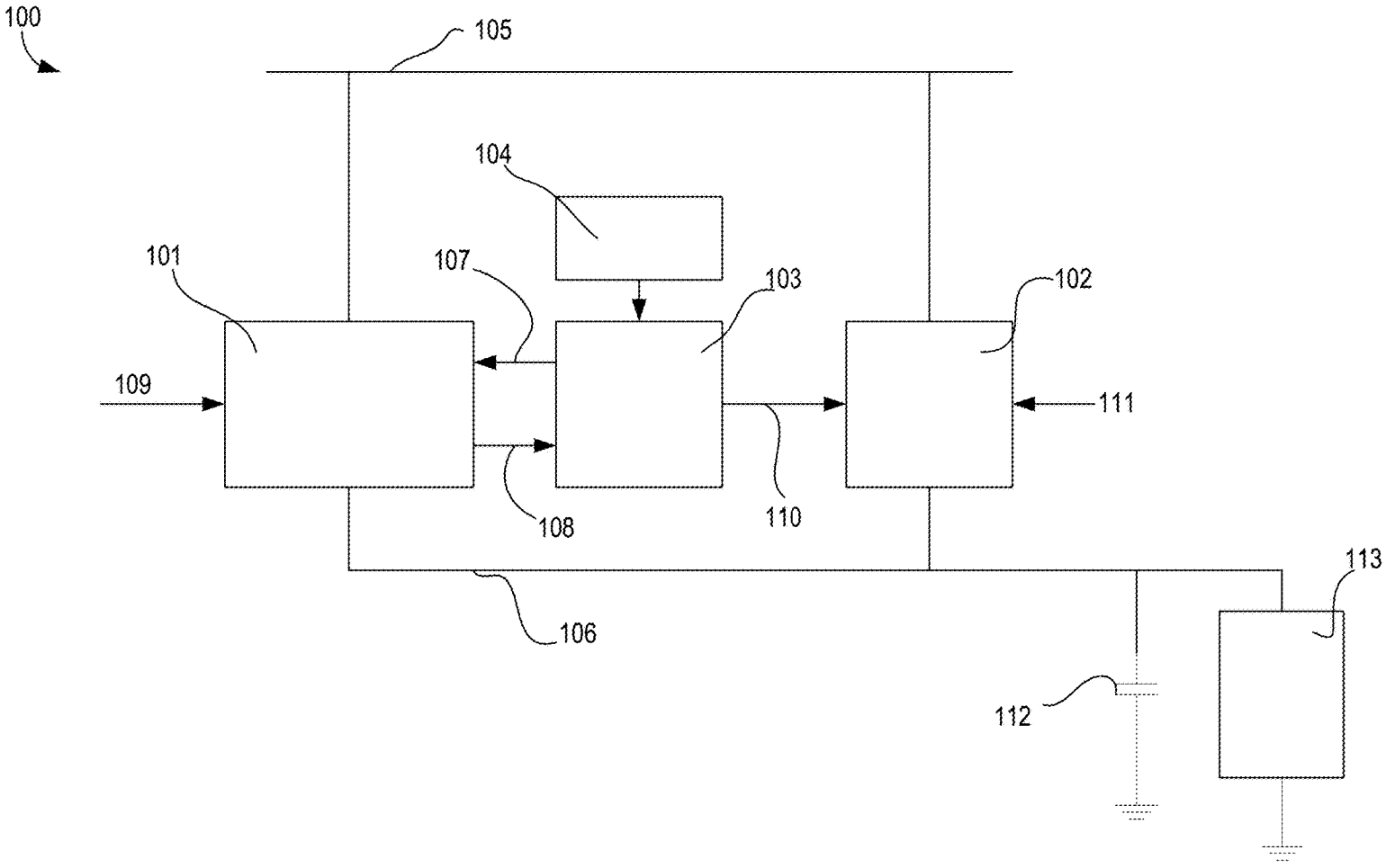
FIG. 1 illustrates a high level architecture of a modular low dropout (LDO) circuitry, according to some embodiments of the disclosure.

Various embodiments describe a modular and configurable LDO circuitry (hereinafter referred to as "LDO") to provide the required specifications of low quiescent current or high power supply rejection ratio (PSRR). Digital LDO (D-LDO) circuitry or module (hereinafter referred to as "D-LDO") inherently has modularity since it uses a number of power p-type switches and decides how many power p-type switches are turned on for a given load. Various embodiments use this inherent modularity in D-LDO to provide programmable PSRR. In some embodiments, one or more analog LDO circuitries or modules (hereinafter referred to as "analog LDO") are used which can provide unit load current equal to or slightly larger than the resolution of the unit p-type switch of the D-LDO.

Here, the term "analog LDO" generally refers to a circuitry that comprises an LDO architecture having at least one transistor which is controllable by a non-rail-to-rail signal (e.g., a signal having a voltage level which is between a supply level and a ground level). The non-rail-to-rail signal here is also referred to as an analog signal. Here, the term "analog signal" generally refers to a continuous signal for which the time varying feature of the signal is a representation of some other time varying quantity. For example, an analog signal is a bias signal which has a continuous voltage level between a supply level and a ground level.

Here the term "digital LDO" generally refers to a circuitry that comprises an LDO architecture having at least one transistor which is controllable by a rail-to-rail signal (e.g., a signal having a voltage level which is one of supply level or ground level). The rail-to-rail signal is also referred to as a digital signal. Here, the term "digital signal" generally refers to a sequence discrete signals which may have two possible values—a logic high value equal to a supply rail level and a logic low value equal to a ground rail level. A digital signal generally toggles rail-to-rail (e.g., from supply level to ground level).

In some embodiments, when a loading application demands higher or lower PSRR, the digital power p-type switch is replaced with unit an analog LDO as necessary, thus providing the lowest current for a given PSRR requirement. In some embodiments, a single or 'N' number of analog LDOs, where 'N' is an integer greater or equal to two, can be enabled based on the need for PSRR. For example, for higher PSRR, more analog LDOs can be enabled to operate in conjunction with the D-LDO. The architecture of some embodiments provides modularity with a single unit analog LDO design and may also scale the quiescent current consumption with load for optimal current consumption with varying load current. The architecture of some embodiments uses a digital controller to program the number of unit analog LDOs (or a set of analog LDOs) to give the optimal current consumption for a given PSRR requirement. As such, the LDO architecture of various embodiments provides programmability for PSRR with a modular architecture, to easily adapt the design for low quiescent current LDO or high PSRR LDO with the same design. Here the term "set" of things generally refers to one or more things having a common property. For example a set of analog LDOs comprises one or more analog LDOs.

Conventional D-LDOs usually adopt a synchronous control scheme, where a clock signal is utilized to realize the operation. In such D-LDOs, voltage tracking speed can be increased by increasing the operating frequency of the clock signal. However, an increase in clock frequency results in increase in power consumption. A trade-off between voltage tracking speed and current efficiency exists in the synchronous D-LDO regulator design.

Various embodiments also describe an asynchronous D-LDO that avoids a large voltage droop caused by large load step changes. The asynchronous D-LDO of some embodiments allows for a voltage droop limit when the load steps up or unloads. In some embodiments, asynchronous D-LDO uses two (e.g., high and low) reference voltage thresholds to determine clamp (e.g., turn-on all the power switches) and unclamp (e.g., turn-off all the power switches) operations. In some embodiments, when the output voltage (e.g., voltage provided to the load) becomes lower than the low reference voltage, then, the clamp operation is taken. In some embodiments, when the output voltage becomes higher than the high reference voltage, then, the unclamp function is taken. In some embodiments, when the output voltage is between the low and high reference voltages, a shifted register value determines the strength of power devices (e.g., p-type devices, n-type devices, or a combination of them). In some embodiments, the shifted register value is determined by clamp and unclamp signals. For example, the shift register value increases with assertion of a clamp signal and decreases in value with the assertion of an unclamp signal.

In conventional synchronous or asynchronous D-LDO design, the shift register allows only one power switch to be turned on or off during regulation. In that case, the speed of the loop determines the maximum voltage droop. In some embodiments, the clamp operation turns on all the power switches while the unclamp operation turns off all the power switches in the event of load step changes. In this example, in a large step load/unload changes, power devices are immediately turned on/off so that the maximum voltage droop or voltage overshoot can be reduced or minimized. In some embodiments, the D-LDO is a clock-less design, thus allowing to further decrease power consumption than traditional synchronous D-LDOs. Other technical effects will be evident from the various figures and embodiments.

In the following description, numerous details are discussed to provide a more thorough explanation of embodiments of the present disclosure. It will be apparent, however, to one skilled in the art, that embodiments of the present disclosure may be practiced without these specific details. In other instances, well-known structures and devices are shown in block diagram form, rather than in detail, in order to avoid obscuring embodiments of the present disclosure.

Note that in the corresponding drawings of the embodiments, signals are represented with lines. Some lines may be thicker, to indicate more constituent signal paths, and/or have arrows at one or more ends, to indicate primary information flow direction. Such indications are not intended to be limiting. Rather, the lines are used in connection with one or more exemplary embodiments to facilitate easier understanding of a circuit or a logical unit. Any represented signal, as dictated by design needs or preferences, may actually comprise one or more signals that may travel in either direction and may be implemented with any suitable type of signal scheme.

Throughout the specification, and in the claims, the term "connected" means a direct connection, such as electrical, mechanical, or magnetic connection between the things that are connected, without any intermediary devices. The term "coupled" means a direct or indirect connection, such as a direct electrical, mechanical, or magnetic connection between the things that are connected or an indirect connection, through one or more passive or active intermediary devices. The term "circuit" or "module" may refer to one or more passive and/or active components that are arranged to cooperate with one another to provide a desired function. The term "signal" may refer to at least one current signal, voltage signal, magnetic signal, or data/clock signal. The meaning of "a," "an," and "the" include plural references. The meaning of "in" includes "in" and "on."

The terms "substantially," "close," "approximately," "near," and "about," generally refer to being within +/−10% of a target value (unless specifically specified). Unless otherwise specified the use of the ordinal adjectives "first," "second," and "third," etc., to describe a common object, merely indicate that different instances of like objects are being referred to, and are not intended to imply that the objects so described must be in a given sequence, either temporally, spatially, in ranking or in any other manner.

For the purposes of the present disclosure, phrases "A and/or B" and "A or B" mean (A), (B), or (A and B). For the purposes of the present disclosure, the phrase "A, B, and/or C" means (A), (B), (C), (A and B), (A and C), (B and C), or (A, B and C).

For purposes of the embodiments, the transistors in various circuits and logic blocks described here are metal oxide semiconductor (MOS) transistors or their derivatives, where the MOS transistors include drain, source, gate, and bulk terminals. The transistors and/or the MOS transistor derivatives also include Tri-Gate and FinFET transistors, Gate All Around Cylindrical Transistors, Tunneling FET (TFET), Square Wire, or Rectangular Ribbon Transistors, ferroelectric FET (FeFETs), or other devices implementing transistor functionality like carbon nanotubes or spintronic devices. MOSFET symmetrical source and drain terminals i.e., are identical terminals and are interchangeably used here. A TFET device, on the other hand, has asymmetric Source and Drain terminals. Those skilled in the art will appreciate that other transistors, for example, Bi-polar junction transistors—BJT PNP/NPN, BiCMOS, CMOS, eFET, etc., may be used without departing from the scope of the disclosure. The term "MN" indicates an n-type transistor (e.g., NMOS, NPN BJT, etc.) and the term "MP" indicates a p-type transistor (e.g., PMOS, PNP BJT, etc.).

FIG. 1 illustrates a high level architecture of a modular LDO 100, according to some embodiments of the disclosure. In some embodiments, modular LDO 100 comprises a D-LDO 101, analog LDO 102, control logic or circuitry 103, PSSR programmability logic or circuitry 104, first power supply node 105 (e.g., ungated power supply node), second power supply node 106 (e.g., gated power supply node), D-LDO control signal line(s) 107, control logic or circuitry control signal lines(s) 108, reference voltage(s) 109, analog LDO control signal line(s) 110, reference voltage 111, load capacitor 112 (which may reside inside or outside the modular LDO boundary), and load 113 (e.g., processing core, logic, or any power domain).

In some embodiments, D-LDO 101 comprises p-type power transistors which are coupled between the first and second supply nodes 105 and 106. In some embodiments, these p-type power transistors are digitally controlled by a digital controller that compares the voltage on the second supply node 106 (or a derivative of that voltage) against one or more reference voltages 109, and accordingly turns on or off the power transistors (e.g., p-type transistors, n-type transistors, or a combination of them). Here, the term "digitally controlled" generally refers to controlling a device by a signal which is either logic high (e.g., the line carrying the signal is charged to supply level) or logic low (e.g., the line or node carrying the signal is discharged to ground level) so as to fully turn off or on the device. In some embodiments, D-LDO 101 comprises one or more comparators that compare the voltage on the second supply node 106 (or a derivative of that voltage) against one or more reference voltages 109. In some embodiments, the output of the comparators is received a shift register which increments or decrements its output according to the comparison result.

In some embodiments, analog LDO 102 comprises one or more p-type devices coupled between first and second supply nodes 105 and 106, and controllable by an analog signal. The one or more p-type devices can also be replaced by n-type devices or a combination of p-type and n-type devices. Here, the term "analog signal" generally refers to a non-rail-to-rail signal. For example, an analog signal may be a voltage which is between the voltage levels of the power supply on node 105 and ground. In some embodiments, analog LDO 102 comprises a comparator or amplifier that compares the voltage on node 106 (or a derivative of that voltage) against voltage reference 111. As such, the current through the p-type device of the analog LDO 102 is adjusted, which in turn adjusts the voltage on node 106. In some embodiments, analog LDO 102 is always on. Here the term "always on" device generally refers to a device which is active or operating in normal condition using a powered up power supply level.

In some embodiments, analog LDO 102 comprises a plurality of analog LDOs, where at least one of the LDO is always on while the other LDOs can be turned on/off (e.g., enabled) by control signal on line 110. Here, labels for nodes and signals may be interchangeably used. For example, 110 may refer to node 110 or signal on node or line 110 according to the context of the sentence. In some embodiments, all analog LDOs in block 102 are capable of being enabled or disabled by control signal 110.

In some embodiments, when load 113 demands higher or lower PSRR, the digital power switch of D-LDO 101 is replaced and/or complemented with an analog LDO (e.g., an LDO of block 102) as necessary providing the lowest current for a given PSRR requirement. In some embodiments, a single or 'N' number of analog LDOs in block 102, where 'N' is an integer greater or equal to two, can be enabled based on the need for PSRR.

For example, for higher PSRR, more analog LDOs of block 102 can be enabled to operate in conjunction with D-LDO 101. The architecture of some embodiments not only provides modularity with a single unit analog LDO design but also scales the quiescent current consumption with load for the optimal current consumption with varying load current. The architecture of some embodiments uses a digital controller (e.g., part of D-LDO 101 and/or control circuitry 103) to program the number of unit analog LDOs of block 102 to give the optimal current consumption for a given PSRR requirement. As such, the LDO architecture of various embodiments provides programmability for PSRR with a modular architecture, to easily adapt the design for low quiescent current LDO or high PSRR LDO with the same design. In some embodiments, the programmability for PSRR is provided by logic 104 which can determine the number of analog LDOs of block 102 to be enabled.

Figure 2:
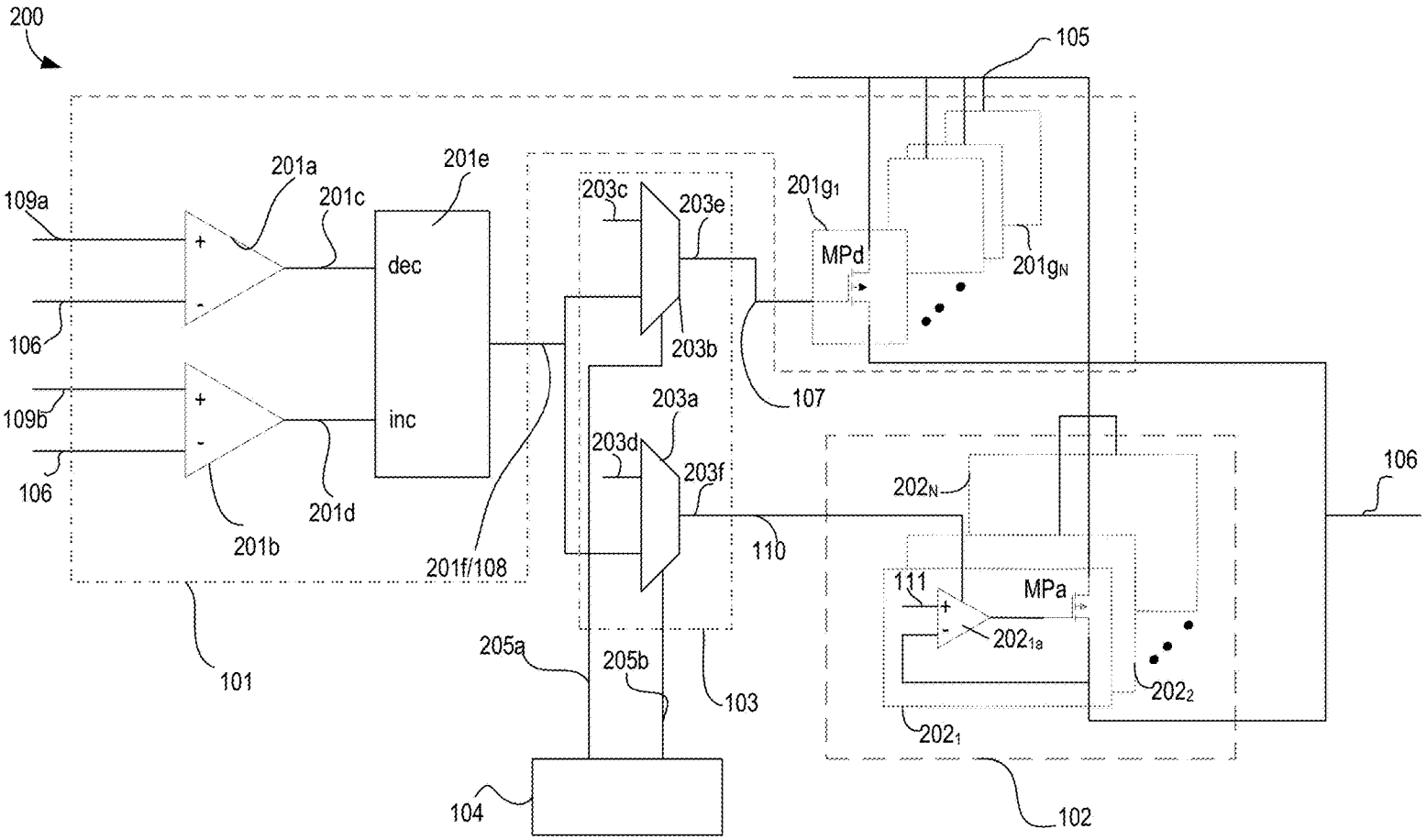
FIG. 2 illustrates a schematic view of the modular LDO of FIG. 1, according to some embodiments of the disclosure.

FIG. 2 illustrates a schematic view 200 of the modular LDO of FIG. 1, according to some embodiments of the disclosure. It is pointed out that those elements of FIG. 2 having the same reference numbers (or names) as the elements of any other figure can operate or function in any manner similar to that described, but are not limited to such.

In some embodiments, D-LDO 101 comprises comparators 201*a* and 201*b*, shift register 201*e*, and power devices $\mathbf{201}g_{1\text{-}N}$, where 'N' is an integer. Any suitable comparator design can be used for implementing comparators 201*a* and 201*b*. In some embodiments, voltage reference 109 represents two reference voltages 109*a* and 109*b*, which are provided to the non-inverting terminals of comparators 201*a* and 201*b*, respectively. For example, reference voltage 109*a* is Vef+ offset while reference voltage 109*b* is Vref-offset, where "offset" may be a programmable or predetermined voltage level (e.g., 35 mV). In some embodiments, shift register 201*e* can decrement or increment its output value on node 201*f*/108 according to outputs 201*c* and 201*d*, respectively. For example, when the output on node 201*c* is high while the output on node 201*d* is low, then shift register 201*e* decrements the output value on node 201*f*/108 by one. In some embodiments, this value is an N-bit value and is used for turning on/off the power devices $\mathbf{201}g_{1\text{-}N}$. In some embodiments, one or more bits of the output code 201*f*/108 can be used for enabling one or more analog LDOs 102.

While the embodiments illustrates one p-type transistor MPd per power device, any number of transistors can be packed per power device. For example, transistors can be coupled together in parallel in each power device. In some embodiments, transistors in each power device are stacked or cascoded. For example, when the power supply on node 105 is higher than the allowable supply range for a process node, then to protect the transistors in the power device, the transistors can be stacked between nodes 105 and 106. The various embodiments are not limited to p-type transistor for the power device. For example, in some embodiments, the power device comprises an n-type device, a p-type device, or a combination of them.

In some embodiments, the output code 201*f*/108 is masked by logic 103 according to control signals 205*a/b* from PSSR logic 104. For example, when higher PSSR is desired, PSSR logic 104 may cause select line 205*b* to enable one or more analog LDOs. In some embodiments, analog LDO bock 102 comprises one or more analog LDOs $\mathbf{202}_{1\text{-}N}$, where 'N' is an integer (which may be same or different than the number 'N' for p-type power devices of D-LDO 101). In some embodiments, analog LDO $\mathbf{202}_1$ comprises a transistor coupled to nodes 105 and 106 and a comparator or operational amplifier $\mathbf{202}_{1a}$. In some embodiments, comparator or operational amplifier $\mathbf{202}_{1a}$ adjusts the drive strength of transistor MPa such that the voltage on node 106 (or its derivative) is same as reference voltage 111.

In some embodiments, control logic 103 comprises multiplexers 203*a* and 203*b* that receive input 201*f*/108 (e.g., the output of shift register 201*e*) and predetermined or programmable inputs 203*d* and 203*c*, respectively. In some embodiments, multiplexers 203*a* and 203*b* are controllable by select signals 205*b* and 205*a*, respectively. The logic values of select signals 205*b* and 205*a* are determined by logic 104 according to the desired PSSR, in accordance with some embodiments. In some embodiments, certain number (or all) power devices $\mathbf{201}g_{1\text{-}N}$ may be turned off and more analog LDOs may be turned on by multiplexers 203*b* and 202*a*, respectively, to increase PSSR. In some embodiments, output 203*e* (same as 107) of multiplexer 203*b* is used to control power devices $\mathbf{201}g_{1\text{-}N}$. In some embodiments, output 203*f* (same as 110) of multiplexer 203*a* is used to control (e.g., enable or disable) analog LDOs $\mathbf{202}_{1\text{-}N}$.

Figure 3:
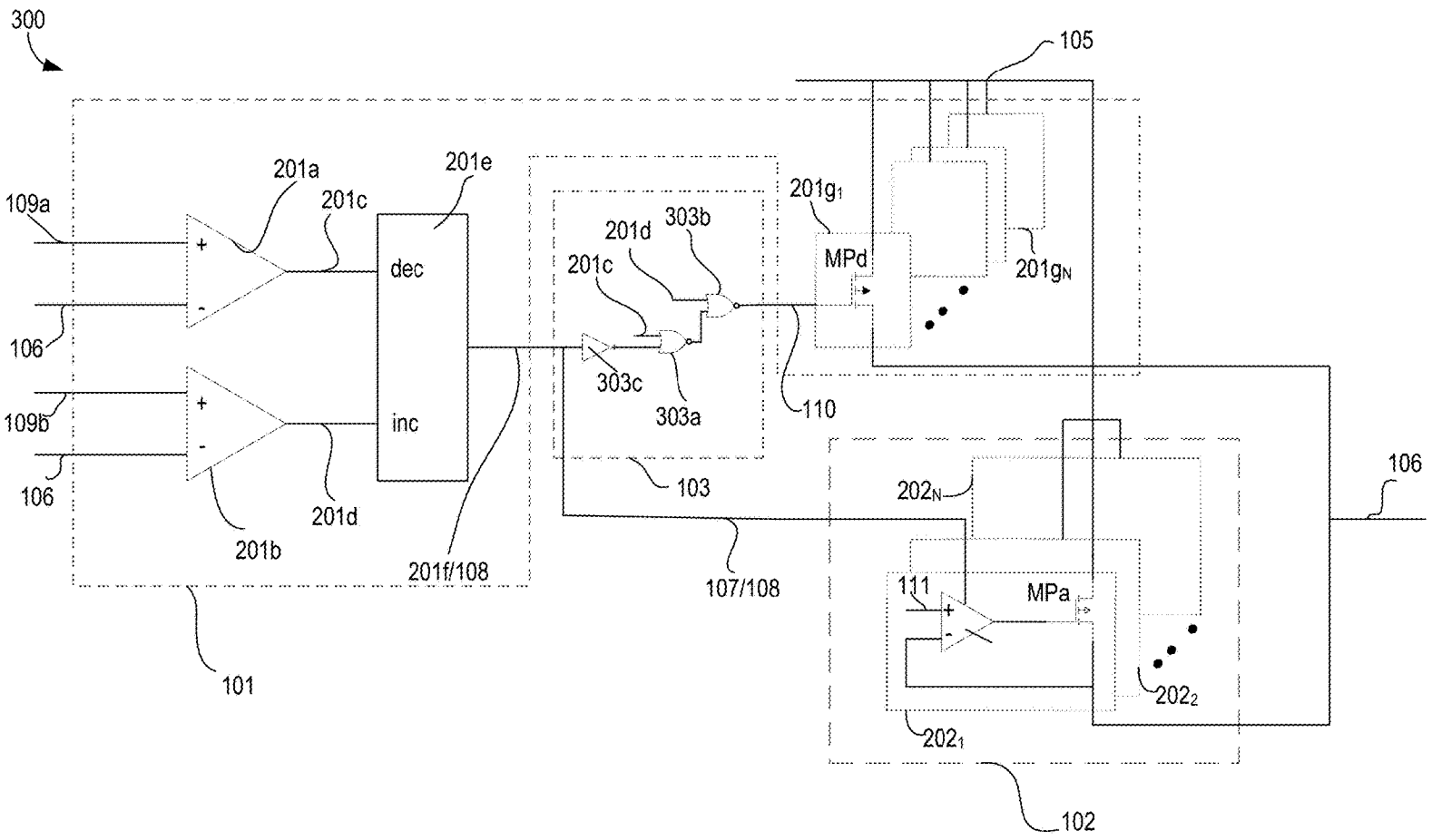
FIG. 3 illustrates a schematic view of the modular LDO of FIG. 1, according to some embodiments of the disclosure.

FIG. 3 illustrates a schematic view 300 of the modular LDO of FIG. 1, according to some embodiments of the disclosure. It is pointed out that those elements of FIG. 3 having the same reference numbers (or names) as the elements of any other figure can operate or function in any manner similar to that described, but are not limited to such.

In some embodiments, D-LDO 101 incorporates clamp and/or unclamp functions provided by control logic 103. Here, the terms "clamp" or "unclamp" generally refer to a function in which a feedback loop is overridden. For example, when an output voltage on the output supply node is outside (e.g., above or below) a threshold level, then a clamp or unclamp situation occurs in which power transistors of an LDO can be forced to be turned on or off regardless of feedback loop dynamics of the LDO. In some embodiments, control logic 103 comprises NOR gates 303*a* and 303*b*, and inverter 303*c*. In some embodiments, output 201*f*/108 of shift register 201*e* is inverted by inverter 303*c*. In some embodiments, the output of inverter 303*c* is provided as input to NOR gate 303*a* which also receives as input the output 201*c* of comparator 201*a*. Here, logic level of output 201*c* indicates an unclamping action (e.g., whether the unclamping action is enabled or disabled). In some embodiments, the output of NOR gate 303*a* is provided as input to NOR gate 303*b* which also receives as input the output 201*d* of comparator 201*b*. Here, the logic level of output 201*d* indicates a clamping action (e.g., whether the clamping action is enabled or disabled). In some embodiments, the output of NOR gate 303*b* is used to control the power gate devices $\mathbf{201}_{g1\text{-}N}$. In some embodiments, output 201*f*/108 of shift register 201*e* is also used to enable or disable analog LDOs $\mathbf{202}_{1\text{-}N}$. In some embodiments, at least one analog LDO from among analog LDOs $\mathbf{202}_{1\text{-}N}$ is always on. In one example, when 'N' associated with block 102 is 5, analog LDO $\mathbf{202}_1$ is always on while 4 analog LDOs $\mathbf{202}_{2\text{-}5}$ are operable to be enabled or disabled.

In some embodiments, most of the current to load 113 is provided by D-LDO 101 and the rest of it is provided by analog LDO block 102. In some embodiments, during the load step changes, D-LDO 101 incorporates a clamp/unclamp action that can turn ON/OFF all the power devices $\mathbf{201}_{g1\text{-}N}$ to clamp the output voltage on node 106 to be within a certain tolerance band during which shift register values 201*f*/108 are incremented/decremented to bring the number of power devices $\mathbf{201}_{g1\text{-}N}$ to the correct amount. Any remaining load current not provided by power devices $\mathbf{201}_{g1\text{-}N}$(e.g., because power devices $\mathbf{201}_{g1\text{-}N}$ are clamped or disabled), is provided by analog LDO 102, in accordance with some embodiments. As such, analog LDO 102 eventually regulates the output voltage to the target reference voltage 111 eliminating inherent toggling behavior of D-LDO 101. Therefore, in addition to all the other benefits stated previously, various embodiments also reduce the switching currents in D-LDO 101 caused by charging and discharging the gate of power switches with the addition of the analog LDO 102 in parallel.

In some embodiments, shift register 201*e* controls power switches $\mathbf{201}_{g1\text{-}N}$ when the output voltage (Vout) on node 106 is between high and low reference voltages 109*a* and 109*b*, respectively. When Vout goes below a low reference voltage, clamp signal 201*d* turn on all the power switches $\mathbf{201}_{g1\text{-}N}$ and increases count of shift register 201*e* by 1. And when Vout goes above the high reference voltage, unclamp signal 201*c* turns off all the power switches $\mathbf{201}_{g1\text{-}N}$ and decreases the count of shift register 201*e* by 1.

Figure 4:
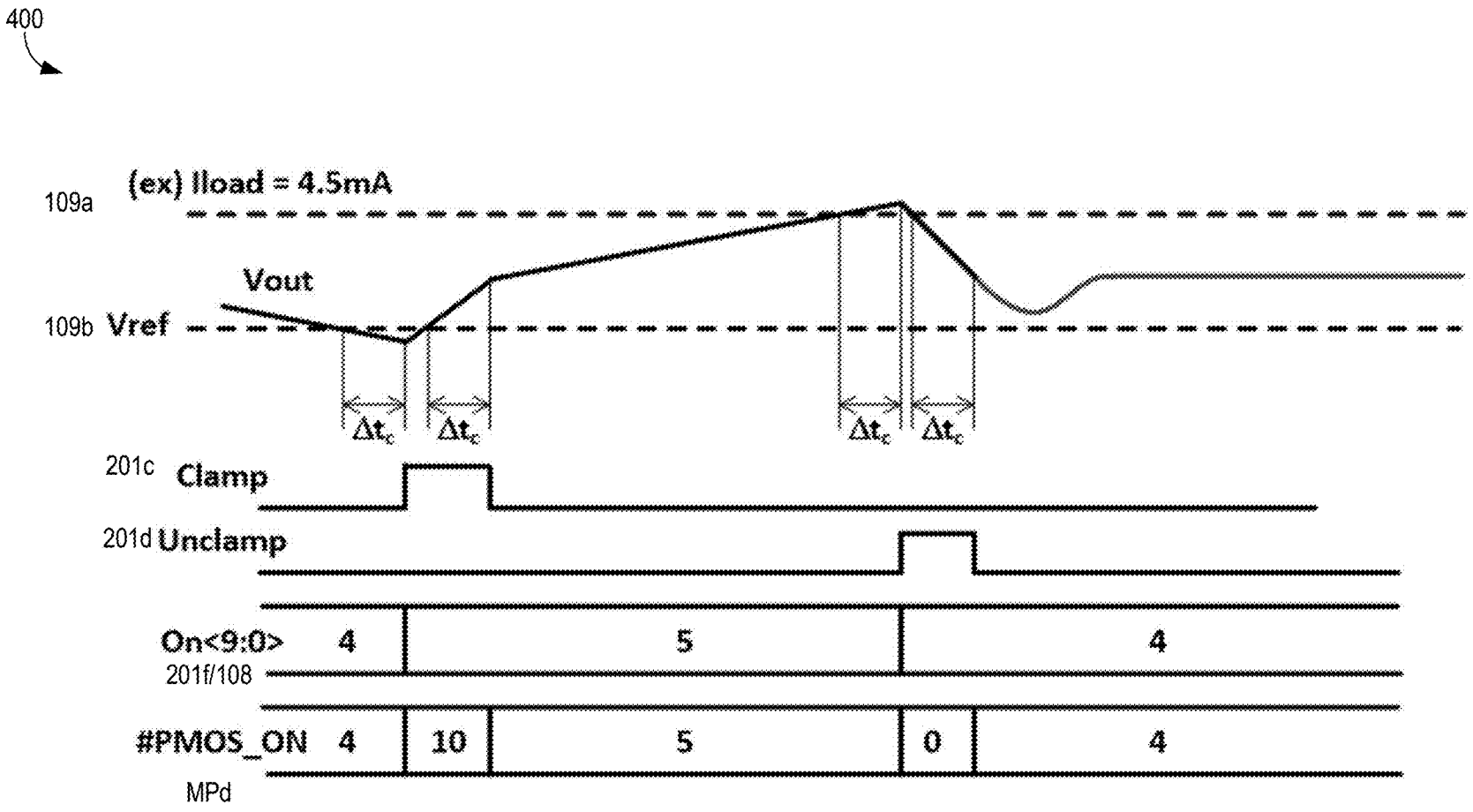
FIG. 4 illustrates a plot showing operation of the modular LDO, according to some embodiments of the disclosure.

FIG. 4 illustrates plot 400 showing the operation of modular LDO 300, according to some embodiments of the disclosure. It is pointed out that those elements of FIG. 4 having the same reference numbers (or names) as the elements of any other figure can operate or function in any manner similar to that described, but are not limited to such.

Here, x-axis is time and y-axis is voltage for waveforms 109*a*, 109*b*, 201*c*, and 201*d*. The numbers across 201*f*/108 indicate the shift register output value over time. The numbers across MPd indicate the number of p-type power devices turned on in D-LDO 101. Plot 400 shows the timing diagram of modular LDO 300 with single always-on analog LDO. In this example, each unit digital power switches $\mathbf{201}_{g1\text{-}N}$ can supply 1 mA and the analog LDO unit module 102 (e.g., $\mathbf{202}_1$) can also supply 1 mA. The timing diagram illustrates a situation where the required load current is 4.5 mA, which therefore necessitates the combination of the analog and the digital LDOs.

In this configuration, the idea is to provide most of the current by D-LDO 101 and the rest of it by analog LDO $\mathbf{201}_1$. During load step changes, D-LDO 101 also incorporates a clamp/unclamp action that can turn ON/OFF all the power p-type devices to clamp the output voltage within a certain tolerance band. Here, the tolerance band is between 109*a* and 109*b* (e.g., +/−35 mV). The time $\Delta t_c$ indicates the propagation delay of the comparators of D-LDO 101. When Vout (e.g., voltage on node 106) falls below Vref 109*b*, signal on node 201*c* is asserted indicating that the p-type devices $\mathbf{201}g_{1\text{-}N}$ need to be turned on (e.g., clamped). As such, the voltage on node 106 begins to rise. When the voltage on node 106 rises above Vref 109*a*, then signal on node 201*d* is asserted indicating that the p-type devices $\mathbf{201}g_{1\text{-}N}$ need to be turned off (e.g., unclamped).

In some embodiments, a digital machine (e.g., a finite state machine or some suitable controller) turns on analog LDO $\mathbf{201}_1$ so that the output on node 206 stabilizes and remains within the voltage tolerance band. In this example, during the clamping/unclamping actions, shift register 201*e* values 201*f*/108 are incremented/decremented to bring the number of power p-type devices to the correct amount, which in this case is 4. In this example, since the load current required is 4.5 mA, the remaining 0.5 mA is then provided by the analog LDO $\mathbf{201}_1$ eventually regulating the output voltage to the target reference voltage eliminating inherent toggling behavior of digital LDOs.

Figure 5:
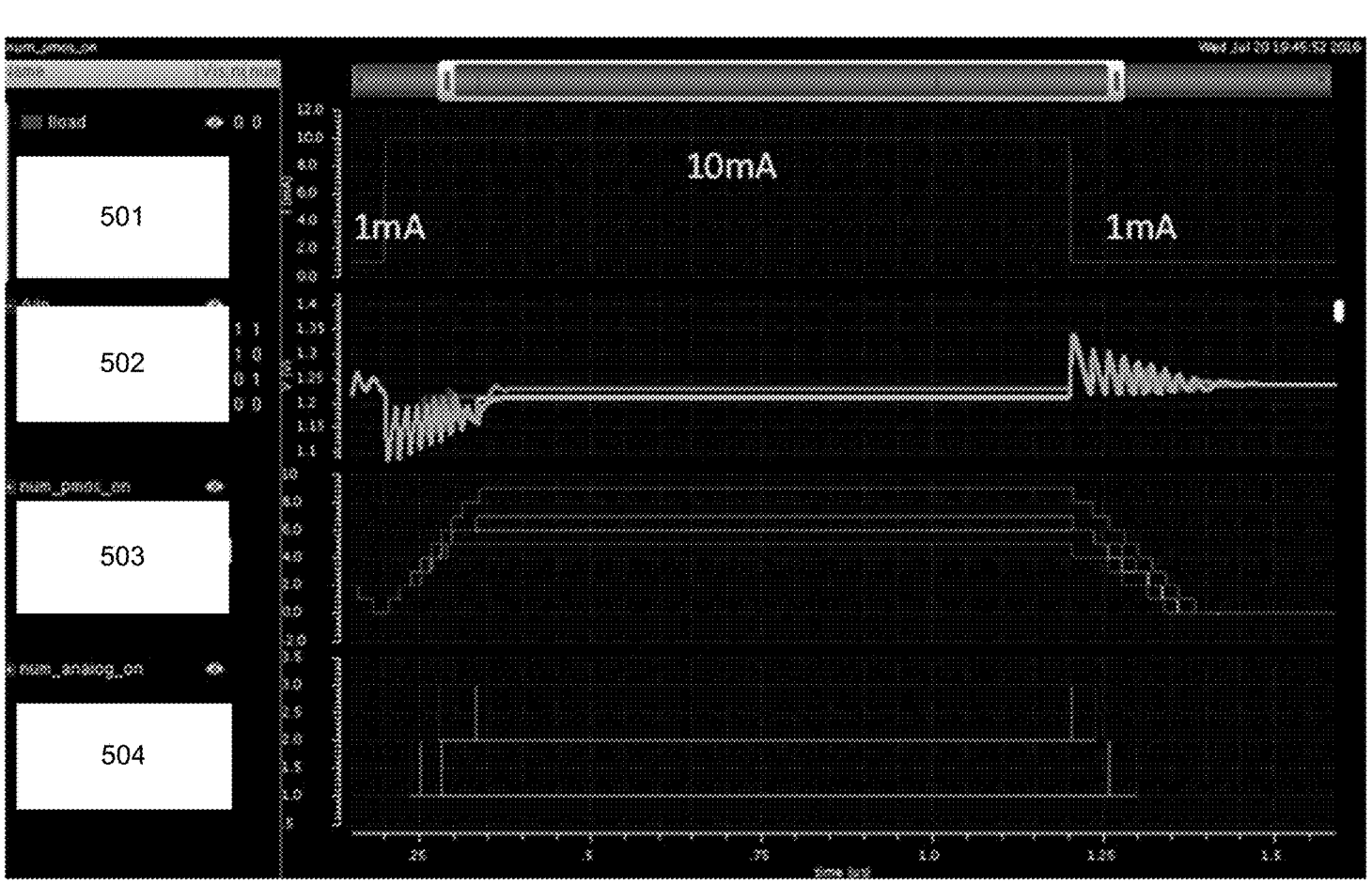
FIG. 5 illustrates a plot showing step load and unload behavior of the modular LDO, according to some embodiments of the disclosure.

FIG. 5 illustrates plot 500 showing step load and unload behavior of the modular LDO, according to some embodiments of the disclosure. It is pointed out that those elements of FIG. 5 having the same reference numbers (or names) as the elements of any other figure can operate or function in any manner similar to that described, but are not limited to such. Here, x-axis is time and y-axis is current for sub-plot 501 which represents load current (i.e., Iload), y-axis is voltage for sub-plot 502 which represents voltage on node 106 for various LDO configurations (i.e., Vout), y-axis for sub-plot 503 is the number of p-type devices of D-LDO 101 turned on (i.e., #MPOS_ON), and y-axis for sub-plot 504 is the number of analog LDOs 102 enabled (i.e., ALDO_ON)

Plot 500 shows step load and unload simulation for 1, 2, 3, and 4 analog LDO use cases. In this example, one analog LDO is always on by default. The toggling or ripples on Vout after load current changes from 1 mA to 10 mA are because of the D-LDO operation. The various waveforms superimposed on each other are because different number of analog LDOs are turned on. The various configurations resulting in these superimposed waveforms are: a) 2 analog LDOs wherein analog LDOs are turned on every 6 ALDO_ON signals, b) 3 analog LDOs wherein turn on analog LDO every 4 ALDO_ON signals, and c) 4 analog LDOs wherein analog LDO is turned on every 3 ALDO_ON signals.

Figure 6:
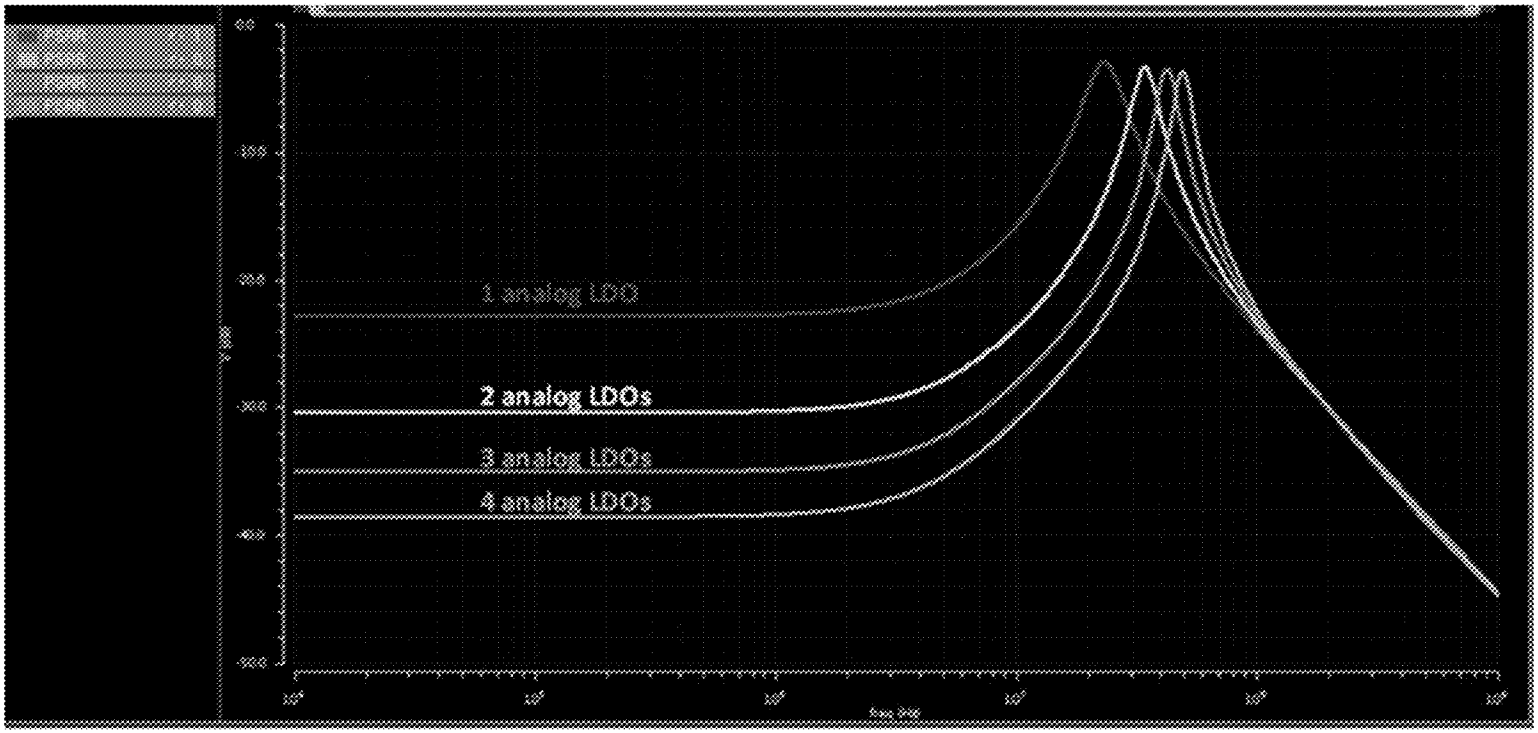
FIG. 6 illustrates a plot showing power supply rejection ratio (PSRR) of the modular LDO, according to some embodiments of the disclosure.

FIG. 6 illustrates plot 600 showing the power supply rejection ratio (PSRR) of modular LDO 200, according to some embodiments of the disclosure. Here, x-axis is frequency and y-axis is PSRR in dB. As more analog LDOs are enabled, the PSRR reduces.

Table 1 illustrates a comparison of the modular LDO architecture of FIG. 1 with a conventional analog LDO. For ISO-comparison with analog LDO the following assumptions are made: the maximum load current of 10 mA, output capacitance of 200 pF and maximum voltage droop of 150 mV.

TABLE 1

| | | | Various Embodiments | | | | |
|---|---|---|---|---|---|---|---|
| | Analog Only LDO | Digital Only LDO | 1 Analog LDO (ALDO) | 2 ALDOs | 3 ALDOs | 4 ALDOs | 10 ALDOs |
| Process Technology Node | | | | 55 nm | | | |
| $V_{in}$[V] on node 105 | | | | 1.8 V to approximately 3.6 V | | | |
| $V_{out}$[V] on node 106 | | | | 1.2 V | | | |
| $I_Q$[uA] (quiescent current) | 100 | 50 | 25 | 30 | 35 | 40 | 70 |
| Max $I_{load}$[mA] through load 113 | | | | 10 | | | |
| $C_{load}$[nF] 112 | | | | 0.2 | | | |
| $\Delta V_{out}$[mV] at $\Delta I_{load}$ | | | | 150 at 10 mA | | | |
| Current efficiency [%] | 99.9 | 99.95 | 99.975 | 99.97 | 99.965 | 99.96 | |
| PSRR [dB] | 56 | N/A | 22 | 30 | 35 | 38 | 56 |
| FOM [in picoseconds (ps)] (FIGURE of merit)* | 30 ps | 15 ps | 7.5 ps | 9 ps | 10.5 ps | 12 ps | |

$$*\mathrm{FOM} = T_R \frac{I_Q}{I_{MAX}} = \frac{C \times \Delta V_{OUT}}{I_{MAX}} \frac{I_Q}{I_{MAX}} [\mathrm{ns}]$$

Table 1 shows that the modular LDO architecture of various embodiments with a single always-on analog LDO which can reduce current by 4 times compared to the analog LDO given the same requirement since, 1) various embodiments use a low power asynchronous digital LDO, and 2) p-type device switching current is removed by adding analog LDO 102.

Figure 7:
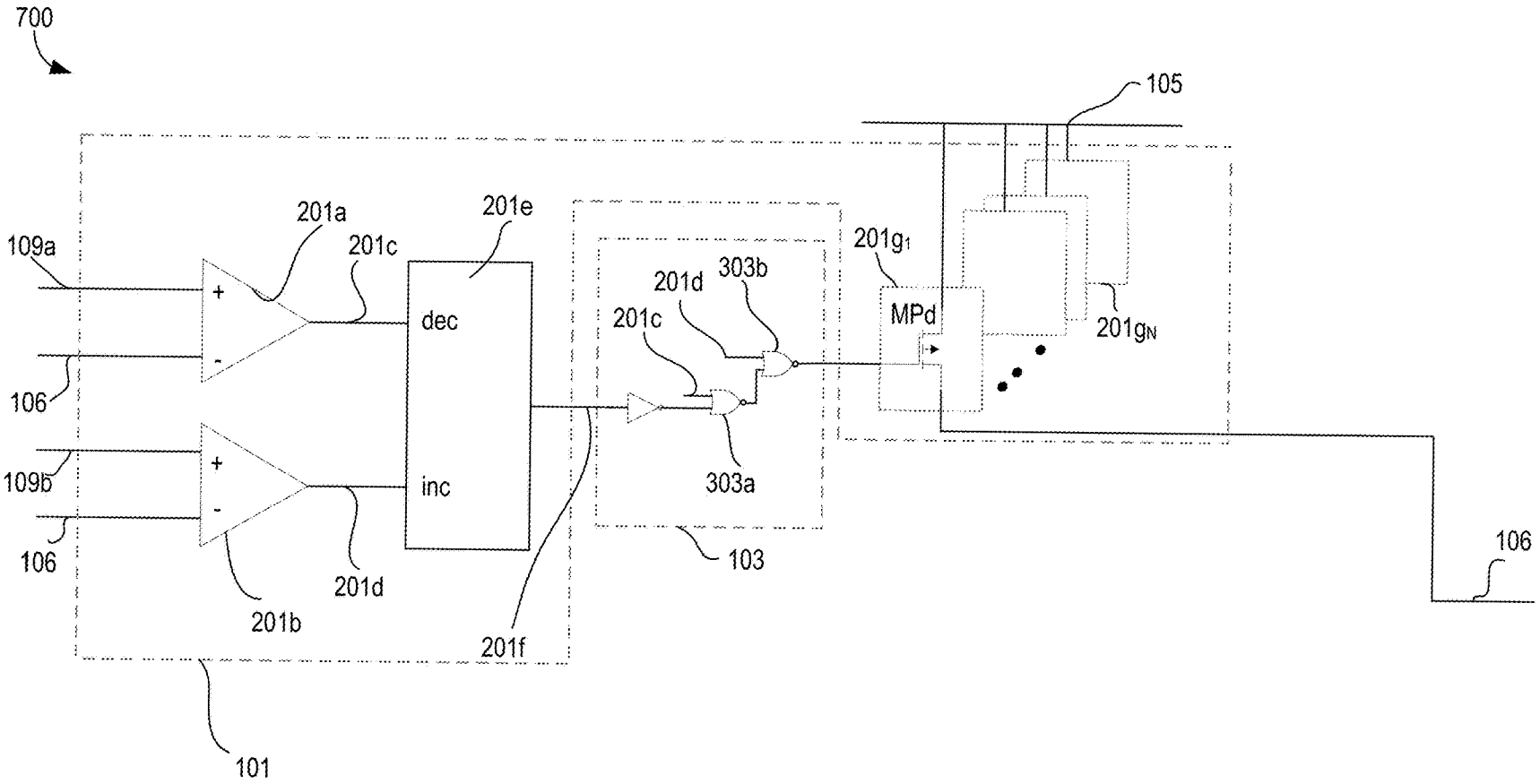
FIG. 7 illustrates a schematic view of an asynchronous LDO circuitry with clamp and unclamp functions, according to some embodiments of the disclosure.

FIG. 7 illustrates a schematic view of an asynchronous LDO 700 circuitry with clamp and unclamp functions, according to some embodiments of the disclosure. It is pointed out that those elements of FIG. 7 having the same reference numbers (or names) as the elements of any other figure can operate or function in any manner similar to that described, but are not limited to such. FIG. 7 is similar to FIG. 3 except for the removal of the analog LDO block 102. In various embodiments, the control of p-type power devices $\mathbf{201}_{g1\text{-}N}$ is asynchronous (e.g., independent of clock transitions).

In some embodiments, asynchronous D-LDO 700 avoids a large voltage droop caused by large load step changes. The asynchronous D-LDO 700 of some embodiments allows for a voltage droop limit when the load steps up or unloads. In some embodiments, asynchronous D-LDO 700 uses two (e.g., high and low) reference voltage thresholds 109*a* and 109*b*, respectively, to determine clamp (e.g., turn-on all the power switches) and unclamp (e.g., turn-off all the power switches) operations. In some embodiments, when the output voltage (e.g., voltage provided to the load) on node 106 becomes lower than the low reference voltage 109*b*, then, the clamp operation is taken. In some embodiments, when the output voltage becomes higher than the high reference voltage 109*a*, then, the unclamp function is taken. In some embodiments, when the output voltage is between the low and high reference voltages, shift register value 201*f* determines the strength of p-type power devices $\mathbf{201}_{g1\text{-}N}$. In some embodiments, the shift register value is determined by clamp and unclamp signals 201*c* and 201*d*, respectively. For example, shift register value 201*f* increases with the assertion of clamp signal 201*c* and decreases in value with the assertion of an unclamp signal 201*d*.

In conventional synchronous or asynchronous D-LDO designs, the shift register allows only one power switch to be turned on or off during regulation. In that case, the speed of the loop determines the maximum voltage droop. In some embodiments, the clamp operation turns on all the power switches $\mathbf{201}_{g1\text{-}N}$ while the unclamp operation turns off all the power switches $\mathbf{201}_{g1\text{-}N}$ in the event of load step changes. In one example, in a large step load/unload changes, power p-type devices $\mathbf{201}_{g1\text{-}N}$ are immediately turned on/off so that the maximum voltage droop or voltage overshoot can be reduced or minimized. In some embodiments, D-LDO 700 is a clock-less design, thus allowing to further decrease power consumption than traditional synchronous D-LDOs.

Figure 8A:
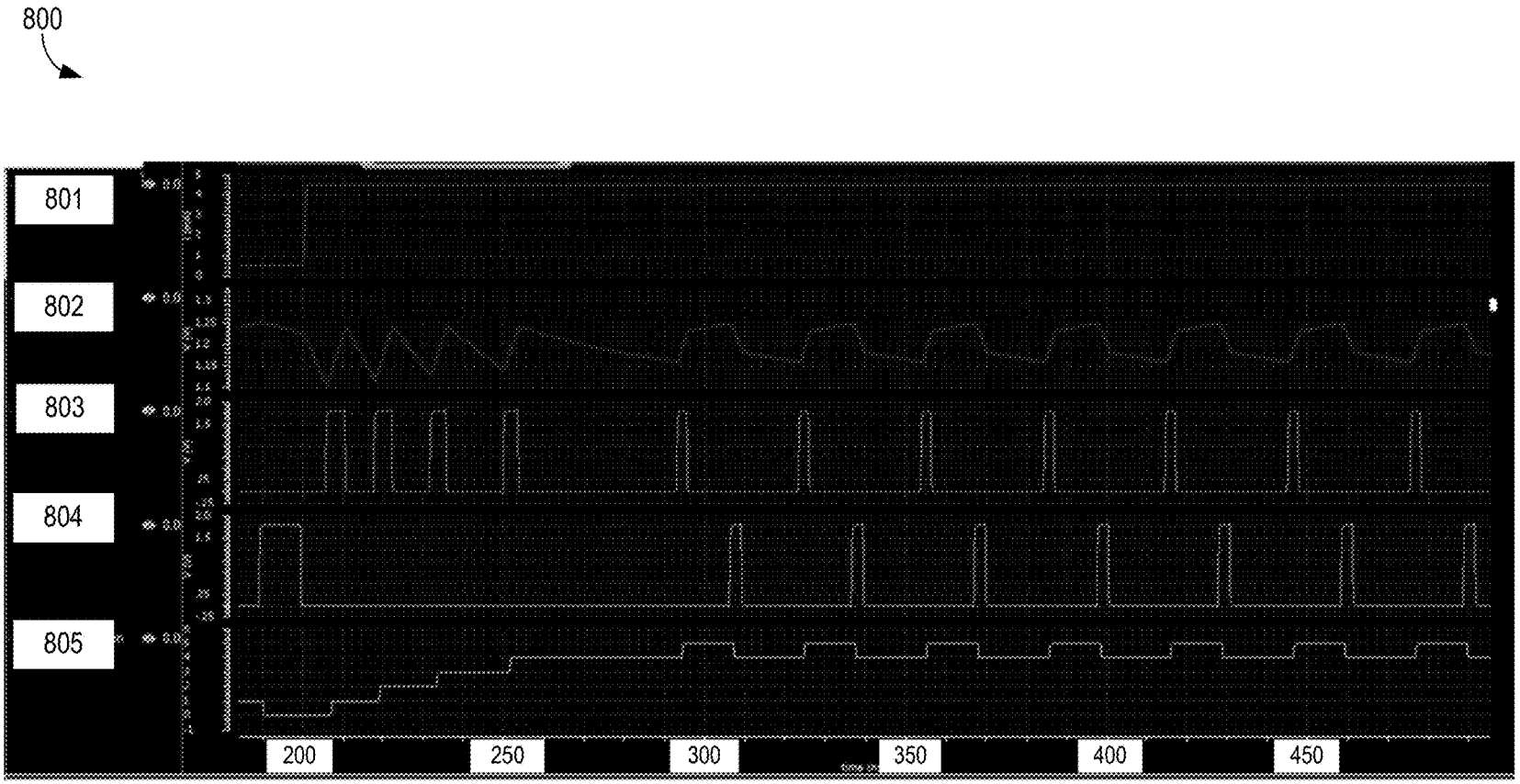
FIGS. 8A-B illustrate plots showing clamping action and unclamping action, respectively, of the asynchronous LDO circuitry, according to some embodiments of the disclosure.
Figure 8B:
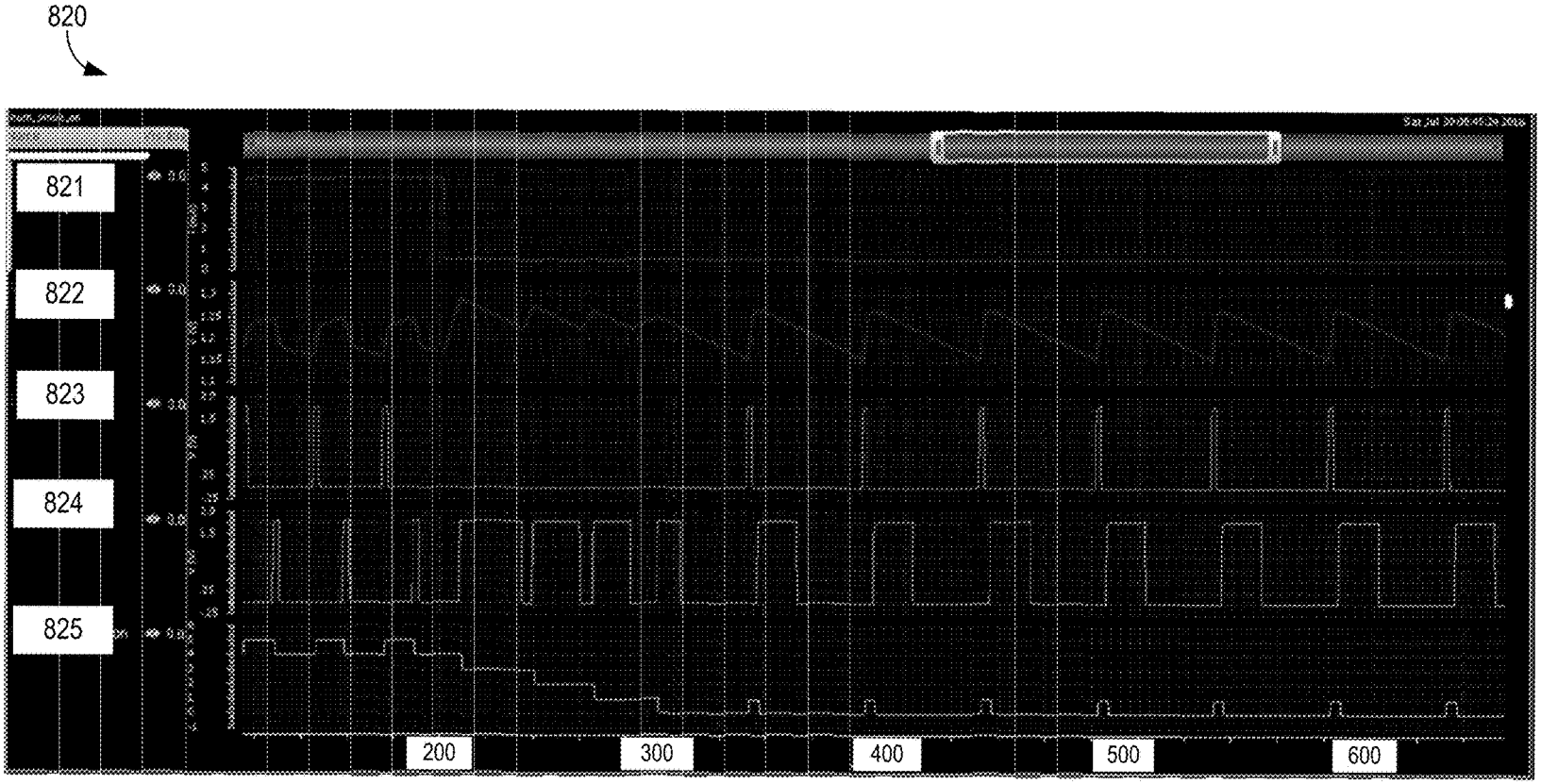

FIGS. 8A-B illustrate plots 800 and 820 showing clamping action and unclamping actions, respectively, of the asynchronous LDO circuitry, according to some embodiments of the disclosure. Plot 800 shows four sub-plots—801, 802, 803, 804, and 805. Sub-plot 801 illustrates load current which steps up from, for example, 0.5 mA to 4.5 mA. Sub-plot 802 illustrates the voltage on node 106. Sub-plot 803 illustrates the clamp signal 201*d*. Sub-plot 804 illustrates the unclamp signal 201*c*. Sub-plot 805 illustrates number of p-type power devices $\mathbf{201}_{g1\text{-}N}$ being turned on. Plot 800 illustrates that D-LDO 700 minimizes or reduces maximum voltage droop on node 106 by clamping p-type power switches $\mathbf{201}_{g1\text{-}N}$ at the event of step load change and eventually settles down.

Plot 820 shows four sub-plots—821, 822, 823, 824, and 825. Sub-plot 821 illustrates load current which steps down from, for example, 4.5 mA to 0.5 mA. Sub-plot 822 illustrates the voltage on node 106. Sub-plot 823 illustrates the clamp signal 201*d*. Sub-plot 824 illustrates the unclamp signal 201*c*. Sub-plot 825 illustrates a number of p-type power devices $\mathbf{201}_{g1\text{-}N}$ being turned on. In this example, D-LDO 700 minimizes voltage overshoot on node 106 by unclamping all the p-type power switches $\mathbf{201}_{g1\text{-}N}$ at the event of step unload change and eventually settles down.

Figure 9:
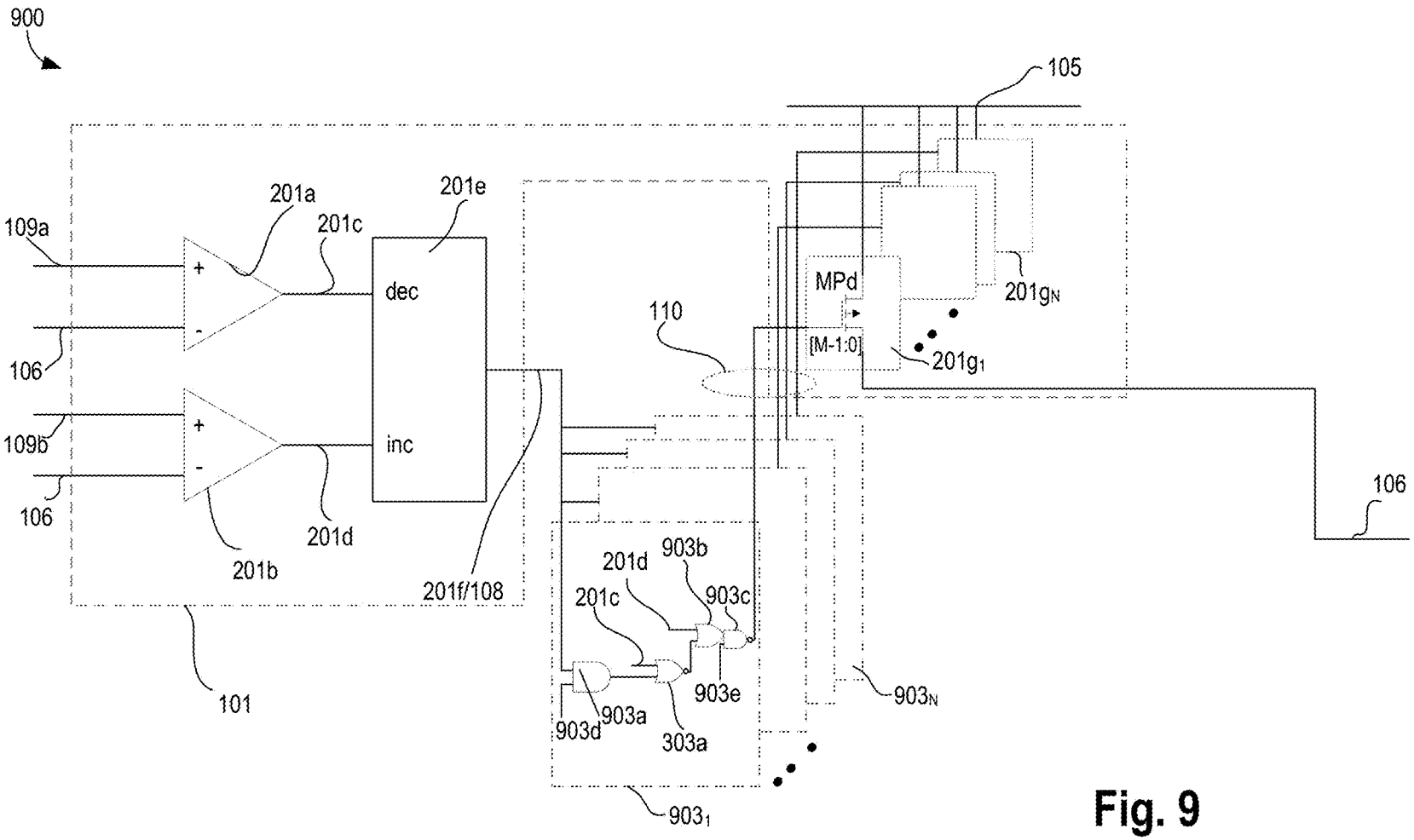
FIG. 9 illustrates a schematic view of an asynchronous LDO circuitry with modular clamp and unclamp functions, according to some embodiments of the disclosure.

FIG. 9 illustrates a schematic view of asynchronous LDO 900 with modular clamp and unclamp functions, according to some embodiments of the disclosure. It is pointed out that those elements of FIG. 9 having the same reference numbers (or names) as the elements of any other figure can operate or function in any manner similar to that described, but are not limited to such. Asynchronous LDO circuitry 900 can handle supply voltage changes, according to some embodiments. During supply voltage changes, it may be needed to adjust the strength of the p-type power switches $\mathbf{201}_{g1\text{-}N}$ to cover the maximum load current needs.

Compared to FIG. 7, here control logic 103 is partitioned into 'N' number of logic circuits $\mathbf{903}_{1\text{-}N}$ for p-type power switches $\mathbf{201}g_{1\text{-}N}$, in accordance with some embodiments. For example, logic circuit $\mathbf{903}_1$ drives p-type power switch $\mathbf{201}_{g1}$, logic circuit $\mathbf{903}_2$ drives p-type power switch $\mathbf{201}_{g2}$, and so on. In some embodiments, each logic circuit (e.g., $\mathbf{903}_1$) includes AND gate 903*a*, NOR gate 303*a*, OR gate 903*b*, and NAND gate 903*c* coupled together as shown. In some embodiments, NOR gate 303*a* is also controlled by unclamp signal 201*c*. In some embodiments, OR gate 903*b* is also controlled by clamp signal 201*d*. In some embodiments, shift register 201*e* controls total 'N' logic units $\mathbf{903}_{1\text{-}N}$ and each unit controls 'M' p-type switches (e.g., M p-type switches in each power switch $\mathbf{201}_{g1}$). Each logic unit receives control bits (e.g., On-en<M−1:0> 903*d* and Clamp_en<M−1:0> 903*e*) which control the strength of the p-type switches.

Figure 10:
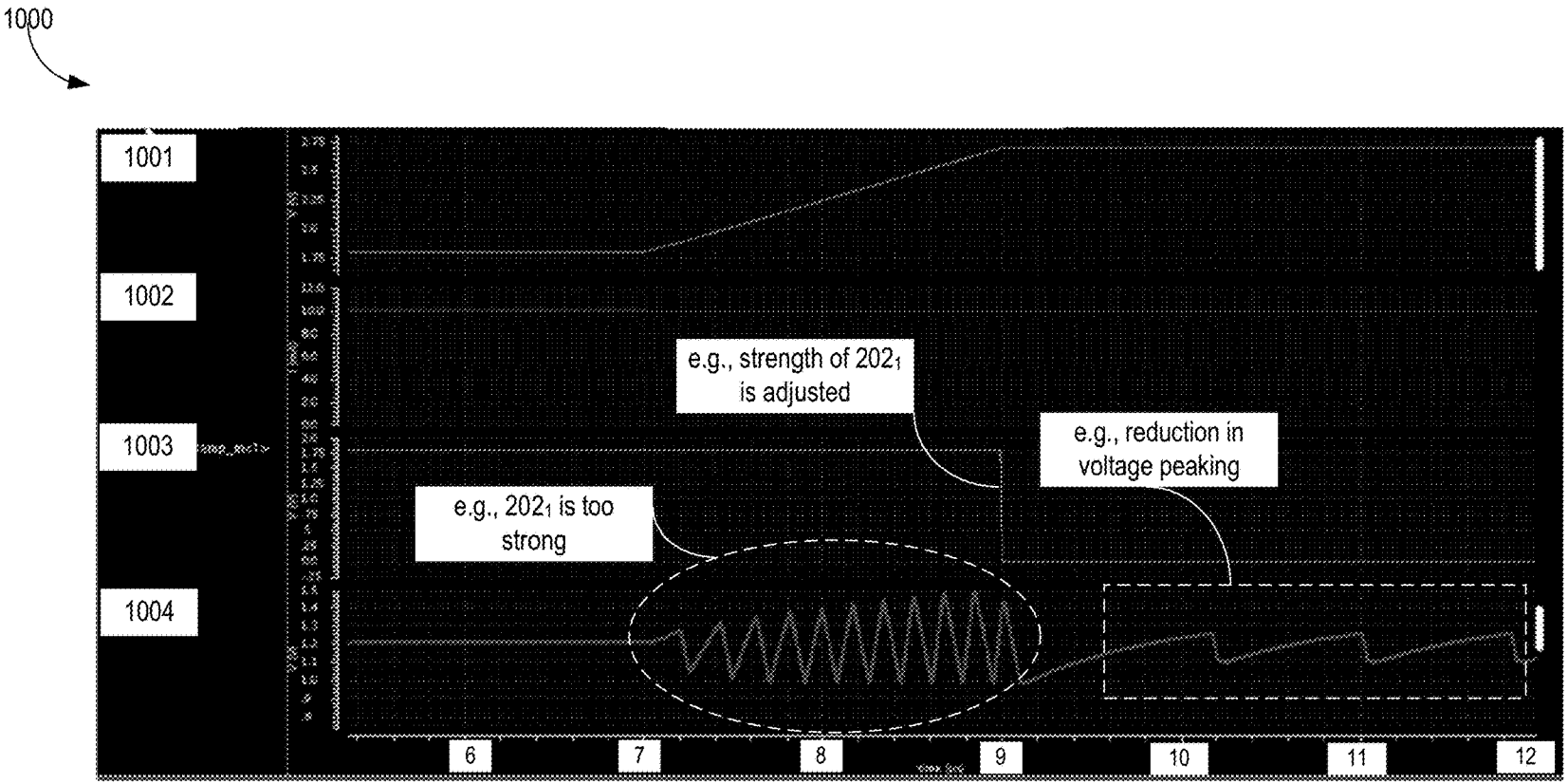
FIG. 10 illustrates a plot showing operation of the asynchronous LDO of FIG. 9, in accordance with some embodiments of the disclosure.

FIG. 10 illustrates plot 1000 showing operation of asynchronous LDO 900, in accordance with some embodiments of the disclosure. Plot 1000 shows four sub-plots—1001, 1002, 1003, and 1004. Sub-plot 1001 is the voltage ramp on input supply on node 105. Sub-plot 1002 is the load current through load 113. Sub-plot 1003 illustrates the adjustment of the strength of a p-type power device (e.g., $\mathbf{201}_1$). Sub-plot 1004 illustrates the voltage on node 106. In this example, as supply voltage increases as shown by sub-plot 1001, the strength of the unit p-type switch (e.g., switch $\mathbf{201}_1$) becomes stronger triggering series of unclamp and clamp actions. After adjusting the strength of the unit p-type switch (e.g., switch $\mathbf{201}_1$) at 0.9 μs, voltage peaking reduces.

Table 2 compares the performance of LDO 900 with a traditional analog LDO. For ISO-comparison with analog LDO, the following assumptions are made: maximum load current is 10 mA, output capacitance is 200 pF and maximum voltage droop is 150 mV.

TABLE 2

| | Analog Only LDO | Digital Only LDO |
|---|---|---|
| Process Technology Node | 55 nm | |
| $V_{in}$ [V] on node 105 | 1.8 V to approximately 3.6 V | |
| $V_{out}$ [V] on node 106 | 1.2 V | |
| $I_Q$ [uA] (quiescent current) | 100 | 50 |
| Max $I_{load}$ [mA] through load 113 | 10 | |
| $C_{load}$ [nF] 112 | 0.2 | |
| $\Delta V_{out}$ [mV] at $\Delta I_{load}$ | 150 at 10 mA | |
| Current efficiency [%] | 99.9 | 99.95 |

TABLE 2-continued

| | Analog Only LDO | Digital Only LDO |
|---|---|---|
| FOM [in picoseconds (ps)] (figure of merit) | 30 ps | 15 ps |

Table 2 shows that LDO 900 can reduce current by 2× compared to analog LDO given the same requirement.

Figure 11:
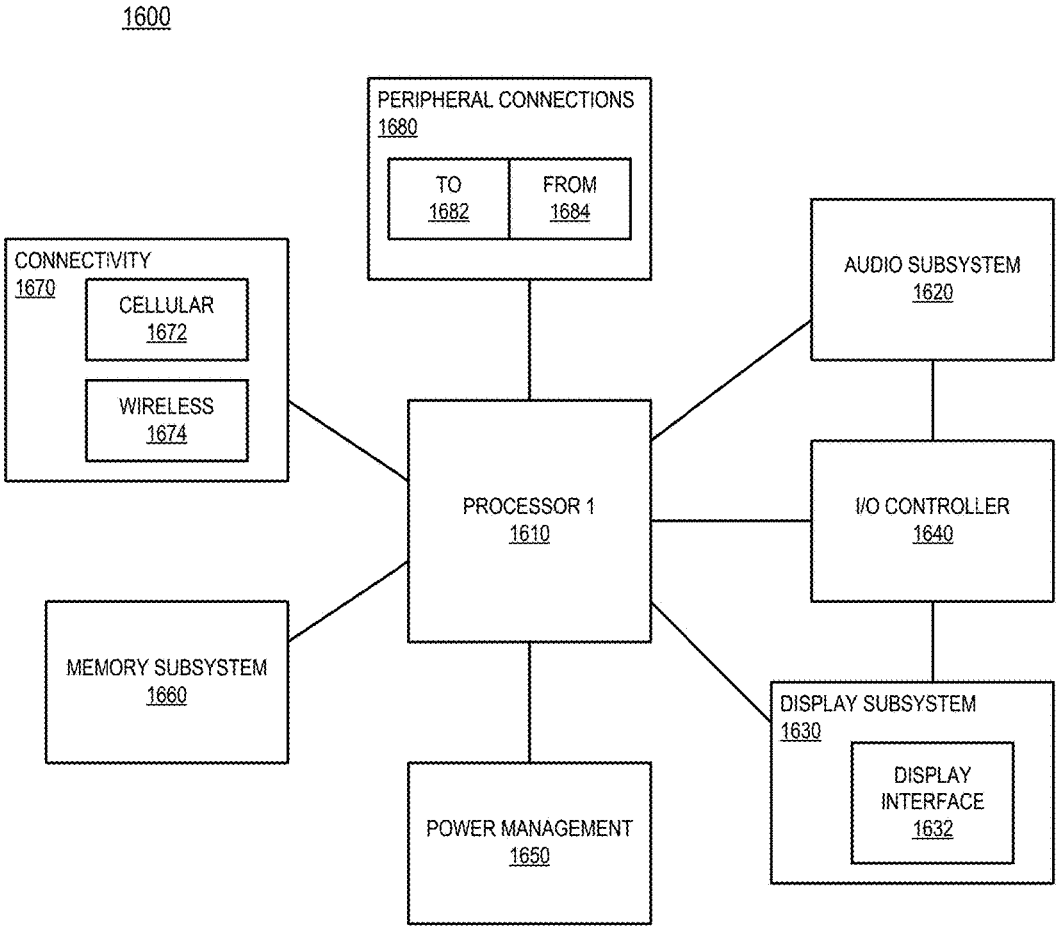
FIG. 11 illustrates a smart device or a computer system or a SoC (System-on-Chip) with modular and/or asynchronous LDO circuitry, according to some embodiments.

FIG. 11 illustrates a smart device or a computer system or a SoC (System-on-Chip) with modular and/or asynchronous LDO circuitry, according to some embodiments. It is pointed out that those elements of FIG. 11 having the same reference numbers (or names) as the elements of any other figure can operate or function in any manner similar to that described, but are not limited to such.

FIG. 11 illustrates a block diagram of an embodiment of a mobile device in which flat surface interface connectors could be used. In some embodiments, computing device 1600 represents a mobile computing device, such as a computing tablet, a mobile phone or smart-phone, a wireless-enabled e-reader, or other wireless mobile device. It will be understood that certain components are shown generally, and not all components of such a device are shown in computing device 1600.

In some embodiments, computing device 1600 includes first processor 1610 with modular and/or asynchronous LDO circuitry, according to some embodiments discussed. Other blocks of the computing device 1600 may also include the modular and/or asynchronous LDO circuitry, according to some embodiments. The various embodiments of the present disclosure may also comprise a network interface within 1670 such as a wireless interface so that a system embodiment may be incorporated into a wireless device, for example, cell phone or personal digital assistant.

In some embodiments, processor 1610 can include one or more physical devices, such as microprocessors, application processors, microcontrollers, programmable logic devices, or other processing means. The processing operations performed by processor 1610 include the execution of an operating platform or operating system on which applications and/or device functions are executed. The processing operations include operations related to I/O (input/output) with a human user or with other devices, operations related to power management, and/or operations related to connecting the computing device 1600 to another device. The processing operations may also include operations related to audio I/O and/or display I/O.

In some embodiments, computing device 1600 includes audio subsystem 1620, which represents hardware (e.g., audio hardware and audio circuits) and software (e.g., drivers, codecs) components associated with providing audio functions to the computing device. Audio functions can include speaker and/or headphone output, as well as microphone input. Devices for such functions can be integrated into computing device 1600, or connected to the computing device 1600. In one embodiment, a user interacts with the computing device 1600 by providing audio commands that are received and processed by processor 1610.

In some embodiments, computing device 1600 comprises display subsystem 1630. Display subsystem 1630 represents hardware (e.g., display devices) and software (e.g., drivers) components that provide a visual and/or tactile display for a user to interact with the computing device 1600. Display subsystem 1630 includes display interface 1632, which includes the particular screen or hardware device used to provide a display to a user. In one embodiment, display interface 1632 includes logic separate from processor 1610 to perform at least some processing related to the display. In one embodiment, display subsystem 1630 includes a touch screen (or touch pad) device that provides both output and input to a user.

In some embodiments, computing device 1600 comprises I/O controller 1640. I/O controller 1640 represents hardware devices and software components related to interaction with a user. I/O controller 1640 is operable to manage hardware that is part of audio subsystem 1620 and/or display subsystem 1630. Additionally, I/O controller 1640 illustrates a connection point for additional devices that connect to computing device 1600 through which a user might interact with the system. For example, devices that can be attached to the computing device 1600 might include microphone devices, speaker or stereo systems, video systems or other display devices, keyboard or keypad devices, or other I/O devices for use with specific applications such as card readers or other devices.

As mentioned above, I/O controller 1640 can interact with audio subsystem 1620 and/or display subsystem 1630. For example, input through a microphone or other audio device can provide input or commands for one or more applications or functions of the computing device 1600. Additionally, audio output can be provided instead of, or in addition to display output. In another example, if display subsystem 1630 includes a touch screen, the display device also acts as an input device, which can be at least partially managed by I/O controller 1640. There can also be additional buttons or switches on the computing device 1600 to provide I/O functions managed by I/O controller 1640.

In some embodiments, I/O controller 1640 manages devices such as accelerometers, cameras, light sensors or other environmental sensors, or other hardware that can be included in the computing device 1600. The input can be part of direct user interaction, as well as providing environmental input to the system to influence its operations (such as filtering for noise, adjusting displays for brightness detection, applying a flash for a camera, or other features).

In some embodiments, computing device 1600 includes power management 1650 that manages battery power usage, charging of the battery, and features related to power saving operation. Memory subsystem 1660 includes memory devices for storing information in computing device 1600. Memory can include nonvolatile (state does not change if power to the memory device is interrupted) and/or volatile (state is indeterminate if power to the memory device is interrupted) memory devices. Memory subsystem 1660 can store application data, user data, music, photos, documents, or other data, as well as system data (whether long-term or temporary) related to the execution of the applications and functions of the computing device 1600.

Elements of embodiments are also provided as a machine-readable medium (e.g., memory 1660) for storing the computer-executable instructions (e.g., instructions to implement any other processes discussed herein). The machine-readable medium (e.g., memory 1660) may include, but is not limited to, flash memory, optical disks, CD-ROMs, DVD ROMs, RAMs, EPROMs, EEPROMs, magnetic or optical cards, phase change memory (PCM), or other types of machine-readable media suitable for storing electronic or computer-executable instructions. For example, embodiments of the disclosure may be downloaded as a computer program (e.g., BIOS) which may be transferred from a remote computer (e.g., a server) to a requesting computer (e.g., a client) by way of data signals via a communication link (e.g., a modem or network connection).

In some embodiments, computing device 1600 comprises connectivity 1670. Connectivity 1670 includes hardware devices (e.g., wireless and/or wired connectors and communication hardware) and software components (e.g., drivers, protocol stacks) to enable the computing device 1600 to communicate with external devices. The computing device 1600 could be separate devices, such as other computing devices, wireless access points or base stations, as well as peripherals such as headsets, printers, or other devices.

Connectivity 1670 can include multiple different types of connectivity. To generalize, the computing device 1600 is illustrated with cellular connectivity 1672 and wireless connectivity 1674. Cellular connectivity 1672 refers generally to cellular network connectivity provided by wireless carriers, such as provided via GSM (global system for mobile communications) or variations or derivatives, CDMA (code division multiple access) or variations or derivatives, TDM (time division multiplexing) or variations or derivatives, or other cellular service standards. Wireless connectivity (or wireless interface) 1674 refers to wireless connectivity that is not cellular, and can include personal area networks (such as Bluetooth, Near Field, etc.), local area networks (such as Wi-Fi), and/or wide area networks (such as WiMax), or other wireless communication.

In some embodiments, computing device 1600 comprises peripheral connections 1680. Peripheral connections 1680 include hardware interfaces and connectors, as well as software components (e.g., drivers, protocol stacks) to make peripheral connections. It will be understood that the computing device 1600 could both be a peripheral device ("to" 1682) to other computing devices, as well as have peripheral devices ("from" 1684) connected to it. The computing device 1600 commonly has a "docking" connector to connect to other computing devices for purposes such as managing (e.g., downloading and/or uploading, changing, synchronizing) content on computing device 1600. Additionally, a docking connector can allow computing device 1600 to connect to certain peripherals that allow the computing device 1600 to control content output, for example, to audiovisual or other systems.

In addition to a proprietary docking connector or other proprietary connection hardware, the computing device 1600 can make peripheral connections 1680 via common or standards-based connectors. Common types can include a Universal Serial Bus (USB) connector (which can include any of a number of different hardware interfaces), DisplayPort including MiniDisplayPort (MDP), High Definition Multimedia Interface (HDMI), Firewire, or other types.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may," "might," or "could" be included, that particular component, feature, structure, or characteristic is not required to be included. If the specification or claim refers to "a" or "an" element, that does not mean there is only one of the elements. If the specification or claims refer to "an additional" element, that does not preclude there being more than one of the additional element.

Furthermore, the particular features, structures, functions, or characteristics may be combined in any suitable manner in one or more embodiments. For example, a first embodiment may be combined with a second embodiment anywhere the particular features, structures, functions, or characteristics associated with the two embodiments are not mutually exclusive.

While the disclosure has been described in conjunction with specific embodiments thereof, many alternatives, modifications and variations of such embodiments will be apparent to those of ordinary skill in the art in light of the foregoing description. The embodiments of the disclosure are intended to embrace all such alternatives, modifications, and variations as to fall within the broad scope of the appended claims.

In addition, well known power/ground connections to integrated circuit (IC) chips and other components may or may not be shown within the presented figures, for simplicity of illustration and discussion, and so as not to obscure the disclosure. Further, arrangements may be shown in block diagram form in order to avoid obscuring the disclosure, and also in view of the fact that specifics with respect to implementation of such block diagram arrangements are highly dependent upon the platform within which the present disclosure is to be implemented (i.e., such specifics should be well within purview of one skilled in the art). Where specific details (e.g., circuits) are set forth in order to describe example embodiments of the disclosure, it should be apparent to one skilled in the art that the disclosure can be practiced without, or with variation of, these specific details. The description is thus to be regarded as illustrative instead of limiting.

The following examples pertain to further embodiments. Specifics in the examples may be used anywhere in one or more embodiments. All optional features of the apparatus described herein may also be implemented with respect to a method or process. Various embodiments here can be can be combined with any of the other embodiments thereby allowing various combinations.

Example 1 is an apparatus which comprises: a first set of devices which is digitally controlled by a first feedback loop that includes a first comparator; and a second set of devices which is controlled by an analog circuitry which is part of a second feedback loop that includes an amplifier, wherein the first set of devices is coupled in parallel to the second set of devices.

Example 2 includes all features of example 1, wherein the first and second set of devices are coupled to a first power supply node and a second power supply node, and wherein the second power supply node is to be coupled to a load.

Example 3 includes all features of example 1, wherein at least one of the devices in the second set of devices is always on or when an input power supply is on.

Example 4 includes all features of example 1, wherein the first feedback loop includes a second comparator, wherein the first and second comparators are to receive first and second references, and wherein the first reference is different than the second reference.

Example 5 includes all features of example 4, wherein the first feedback loop includes a shift register having a first input which is to receive an output of the first comparator, and a second input which is to receive an output of the amplifier.

Example 6 includes all features of example 5, wherein an output of the shift register is used to control the first set of devices.

Example 7 includes all features of example 6, wherein the output of the shift register is a bus having at least two bits.

Example 8 includes all features of example 6, wherein an output of the shift register is masked by the outputs of the first comparator and/or the amplifier.

Example 9 includes all features of example 6, wherein the apparatus of example 6 comprises a first set of multiplexers to receive the output of the shift register and a first predetermined signal, wherein the output of the first set of multiplexers is to digitally control the first set of devices.

Example 10 includes all features of example 9, wherein the apparatus of example 10 comprises a second set of multiplexers to receive the output of the shift register and a second predetermined signal, wherein the output of the second set of multiplexers is to turn on or off at least one device of the second set of devices.

Example 11 includes all features of example 10, wherein the first and second set of multiplexers are controlled by a programmable control.

Example 12 includes all features of example 1, wherein the amplifier is to generate an output which is between a power supply level and a ground level, and wherein the output is to control the second set of devices.

Example 13 includes all features of example 1, wherein the first and second set of devices comprises p-type transistors, n-type transistors, or a combination of them.

Example 14 is an apparatus which comprises: a digital low dropout (LDO) coupled to an input power supply node and an output power supply node; and a set of analog LDOs coupled in parallel to the digital LDO, wherein at least one analog LDO of the set is always on.

Example 15 includes all features of example 14, wherein the apparatus of example 15 comprises a digital controller to control the digital LDO and the set of analog LDOs.

Example 16 includes all features of example 14, wherein the apparatus of example 14 comprises logic to mask an output of the digital controller according to a desired power supply rejection ratio (PSRR).

Example 17 includes all features of example 14, wherein the set of analog LDOs includes p-type devices which are controlled by a non-rail-to-rail output, and wherein the digital LDO includes p-type devices which are controlled by a rail-to-rail output.

Example 18 is a system which comprises: a memory; a processor coupled to the memory, wherein the processor includes a processor core which is powered by a supply generator, wherein the supply generator comprises: a first set of devices which is digitally controlled by a first feedback loop that includes a first comparator; and a second set of devices which is controlled by an analog circuitry which is part of a second feedback loop that includes an amplifier, wherein the first set of devices is coupled in parallel to the second set of devices; and a wireless interface to allow the processor to communicate with another device.

Example 19 includes all features of example 18, wherein the first and second set of devices are coupled to a first power supply node and a second power supply node, and wherein the second power supply node is to be coupled to the processor core.

Example 20 includes all features of example 18, wherein at least one of the devices in the second set of devices is always on.

Example 21 is an apparatus which comprises: a digital low dropout (LDO) coupled to an input power supply node and an output power supply node; and a set of analog LDOs coupled in parallel to the digital LDO, wherein the digital LDO and the set of analog LDOs are controllable to obtain a target Power Supply Rejection Ratio (PSRR).

Example 22 includes all features of example 21, wherein the set of analog LDOs includes p-type devices which are controlled by a non-rail-to-rail output, and wherein the digital LDO includes p-type devices which are controlled by a rail-to-rail output.

Example 23 includes all features of example 21, wherein the apparatus of example 23 comprises a circuitry to override a feedback loop of the digital LDO when an output on the output power supply node is outside a bound of thresholds.

Example 24 includes all features of example 21, wherein the apparatus of example 23 comprises a circuitry to override a feedback loop of the digital LDO when an output on the output power supply node is above or below a threshold.

Example 25 is a method which comprises: controlling a digital low dropout (LDO) coupled to an input power supply node and an output power supply node; and controlling, a set of analog LDOs coupled in parallel to the digital LDO, to obtain a target Power Supply Rejection Ratio (PSRR).

Example 26 includes all features of example 25, wherein the set of analog LDOs includes p-type devices which are controlled by a non-rail-to-rail output, and wherein the digital LDO includes p-type devices which are controlled by a rail-to-rail output.

Example 27 includes all features of example 25, wherein the method of example 27 comprises overriding a feedback loop of the digital LDO when an output on the output power supply node is outside a bound of thresholds.

Example 28 includes all features of example 25, wherein the method of example 28 comprises overriding a feedback loop of the digital LDO when an output on the output power supply node is above or below a threshold.

Example 29 is an apparatus which comprises: means for controlling a digital low dropout (LDO) coupled to an input power supply node and an output power supply node; and means for controlling, a set of analog LDOs coupled in parallel to the digital LDO, to obtain a target Power Supply Rejection Ratio (PSRR).

Example 30 includes all features of example 29, wherein the set of analog LDOs includes p-type devices which are controlled by a non-rail-to-rail output, and wherein the digital LDO includes p-type devices which are controlled by a rail-to-rail output.

Example 31 includes all features of example 29, wherein the apparatus of example 31 comprises means for overriding a feedback loop of the digital LDO when an output on the output power supply node is outside a bound of thresholds.

Example 32 includes all features of example 29, wherein the apparatus of example 31 comprises means for overriding a feedback loop of the digital LDO when an output on the output power supply node is above or below a threshold.

Example 33 is a system which includes: a memory; a processor coupled to the memory, wherein the processor includes a processor core which is powered by a supply generator, wherein the supply generator comprises and apparatus according to any one of examples 1 to 13, examples 14 to 17, examples 21 to 24, or examples 29 to 32; and a wireless interface to allow the processor to communicate with another device.

An abstract is provided that will allow the reader to ascertain the nature and gist of the technical disclosure. The abstract is submitted with the understanding that it will not be used to limit the scope or meaning of the claims. The following claims are hereby incorporated into the detailed description, with each claim standing on its own as a separate embodiment.

We claim:

1. An apparatus comprising:

a first set of devices digitally controlled by a first feedback loop that includes a comparator; and a second set of devices controlled by an analog circuitry which is part of a second feedback loop that includes an amplifier, wherein the first set of devices is coupled in parallel to the second set of devices.

2. The apparatus of claim 1, wherein the first and second set of devices are coupled to a first power supply node and a second power supply node, and wherein the second power supply node is to be coupled to a load.

3. The apparatus of claim 1, wherein at least one of the devices of the second set of devices is always on.

4. The apparatus of claim 1, wherein the comparator is a first comparator, wherein the first feedback loop includes a second comparator, wherein the first and second comparators are to receive first and second references, and wherein the first reference is different than the second reference.

5. The apparatus of claim 4, wherein the first feedback loop includes a shift register having a first input, which is to receive an output of the first comparator, and a second input which is to receive an output of the amplifier.

6. The apparatus of claim 5, wherein an output of the shift register is used to control the first set of devices.

7. The apparatus of claim 6, wherein the output of the shift register is a bus having at least two bits.

8. The apparatus of claim 6, wherein an output of the shift register is masked by the respective outputs of the first comparator and/or the amplifier.

9. The apparatus of claim 6 comprises a first set of multiplexers to receive the output of the shift register and a first predetermined signal, wherein the output of the first set of multiplexers is to digitally control the first set of devices.

10. The apparatus of claim 9 comprises a second set of multiplexers to receive the output of the shift register and a second predetermined signal, wherein the output of the second set of multiplexers is to turn on or off at least one device of the second set of devices.

11. The apparatus of claim 10, wherein the first and second set of multiplexers are controlled by a programmable control.

12. The apparatus of claim 1, wherein the amplifier is to generate an output, which is between a power supply level and a ground level, and wherein the output is to control the second set of devices.

13. The apparatus of claim 1, wherein the first and second set of devices comprises p-type transistors, n-type transistors, or a combination of them.

14. An apparatus comprising:

a digital low dropout (LDO) coupled to an input power supply node and an output power supply node; and a set of analog LDOs coupled in parallel to the digital LDO, wherein at least one analog LDO of the set is always on.

15. The apparatus of claim 14 comprises a digital controller coupled to the digital LDO to control the digital LDO and the set of analog LDOs.

16. The apparatus of claim 15 comprises logic coupled to the digital controller to mask an output of the digital controller in accordance with a desired power supply rejection ratio (PSRR).

17. The apparatus of claim 14, wherein the set of analog LDOs includes p-type devices which are controlled by a non-rail-to-rail output, and wherein the digital LDO includes p-type devices which are controlled by a rail-to-rail output.

18. A system comprising:

a memory;

a processor coupled to the memory, wherein the processor includes a processor core which is powered by a supply generator, wherein the supply generator comprises:

a first set of devices digitally controlled by a first feedback loop that includes a comparator; and a second set of devices controlled by an analog circuitry, which is part of a second feedback loop that includes an amplifier, wherein the first set of devices is coupled in parallel to the second set of devices; and a wireless interface to allow the processor to communicate with another device.

19. The system of claim 18, wherein the first and second set of devices are coupled to a first power supply node and a second power supply node, and wherein the second power supply node is to be coupled to the processor core.

20. The system of claim 18, wherein at least one of the devices in the second set of devices is always on.

21. An apparatus comprising:

a digital low dropout (LDO) coupled to an input power supply node and an output power supply node; and a set of analog LDOs coupled in parallel to the digital LDO, wherein the digital LDO and the set of analog LDOs are controllable to obtain a target Power Supply Rejection Ratio (PSRR).

22. The apparatus of claim 21, wherein the set of analog LDOs includes p-type devices which are controlled by a non-rail-to-rail output, and wherein the digital LDO includes p-type devices which are controlled by a rail-to-rail output.

23. The apparatus of claim 21 comprises a circuitry to override a feedback loop of the digital LDO when an output on the output power supply node is outside a bound of thresholds.

24. The apparatus of claim 21 comprises a circuitry to override a feedback loop of the digital LDO when an output on the output power supply node is above or below a threshold.

* * * * *